US008919229B1

(12) United States Patent
Aldredge et al.

(10) Patent No.: US 8,919,229 B1
(45) Date of Patent: Dec. 30, 2014

(54) ONE HANDED QUICK RELEASE LOCKING PLIERS

(71) Applicants: Robert L. Aldredge, Englewood, OH (US); Daniel J Schaefer, Huber Heights, OH (US)

(72) Inventors: Robert L. Aldredge, Englewood, OH (US); Daniel J Schaefer, Huber Heights, OH (US)

( * ) Notice: Subject to any disclaimer, the term of this patent is extended or adjusted under 35 U.S.C. 154(b) by 0 days.

(21) Appl. No.: 14/338,411

(22) Filed: Jul. 23, 2014

(51) Int. Cl.
*B25B 7/12* (2006.01)

(52) U.S. Cl.
CPC .. *B25B 7/123* (2013.01); *B25B 7/12* (2013.01)
USPC ..... 81/376; 81/372; 81/377; 81/374; 81/378; 81/368; 81/367

(58) Field of Classification Search
CPC ..... B25B 7/123
USPC ..... 81/367–380
See application file for complete search history.

(56) References Cited

U.S. PATENT DOCUMENTS 5,056,385 A 10/1991 Petersen
6,095,019 A 8/2000 Warheit et al.
7,762,162 B2 7/2010 Phillips, Sr. et al.

*Primary Examiner* — Bryan R Muller
(74) *Attorney, Agent, or Firm* — Donald J. Ersler

(57) ABSTRACT

A one handed quick release locking pliers preferably includes a fixed jaw, a movable jaw, a fixed handle, a toggle link, a power link and a movable handle. The fixed jaw is retained in one end of the fixed. The movable jaw is pivotally retained in the one end of the fixed handle. A toggle link release surface extends from the second end of the toggle link. A toggle link stop projection extends outward from the actuation portion. The toggle link stop projection provides an over-center stop for clamping an object. A power link release projection extends outward from the movable handle, substantially perpendicular to the toggle link stop projection. The power link release projection contacts the power link. Moving a second end of the movable handle away from the fixed handle will cause the power link release projection to push the power link and release a clamped object.

13 Claims, 4 Drawing Sheets

ONE HANDED QUICK RELEASE LOCKING PLIERS

BACKGROUND OF THE INVENTION

1. Field of the Invention

The present invention relates generally to hand tools and more specifically to a one handed quick release locking pliers, which requires less effort to operate than that of the prior art.

2. Discussion of the Prior Art

U.S. Pat. No. 5,056,385 to Petersen discloses a compound toggle link. U.S. Pat. No. 6,095,019 to Warheit et al. discloses a locking plier tool. U.S. Pat. No. 7,762,162 to Phillips, Sr. et al. discloses a locking pliers with cam.

Accordingly, there is a clearly felt need in the art for a one handed quick release locking pliers, which requires less effort to operate than that of the prior art.

SUMMARY OF THE INVENTION

The present invention provides a one handed quick release locking pliers, which requires less effort to operate than that of the prior art. The one handed quick release locking pliers (locking pliers) preferably includes a fixed jaw, a movable jaw, a fixed handle, an adjusting screw, a biasing spring, a toggle link, a power link and a movable handle. The fixed jaw, the movable jaw, the fixed handle, the adjusting screw and the biasing spring are preferably taken from an Irwin item no. 502L3 vise grips, but other parts may also be used. U.S. Pat. No. 5,056,385 is hereby incorporated into this patent application by reference in its entirety. The fixed jaw is retained in one end of the fixed handle and the adjusting screw is threadably retained in an opposing end of the fixed handle. The movable jaw is pivotally retained in the one end of the fixed handle. One end of the biasing spring is attached to the movable jaw and the other end is attached to the fixed handle.

The toggle link includes a first end and a second end. A pivot cavity is formed in the first end of the toggle link. A toggle link release surface extends from the second end of the toggle link. The power link preferably includes a U-shaped cross-section. The U-shaped cross-section includes a first power plate extending downward from a first end of a cross power plate and a second power plate extending downward from a second end of the cross power plate. The power link also includes a first end, a middle portion and a second end. A jaw pivot hole is formed through the first end; a handle pivot hole is formed through the middle portion; and a toggle pivot hole is formed through the second end. A jaw pivot pin is retained in the jaw pivot hole and the movable jaw. The second end of the toggle link is pivotally engaged with the toggle pivot hole with a toggle pin.

The movable handle includes a handle portion and an actuation portion. The handle portion includes a first end and a second end. The actuation portion extends from a first end of the handle portion. A handle pivot pin is retained in the handle pivot hole and the actuation portion. A toggle link release projection extends outward from the actuation portion. The toggle link release projection allows an object to be removed from the locking pliers. A power link release projection extends outward from the actuation portion, substantially perpendicular to the toggle link release projection. The power link release projection contacts an edge of the cross power plate. Moving a second end of the movable handle away from the fixed handle will cause the power link release projection to push the cross power plate and release a clamped object.

The power link release projection contacts an edge of the cross power plate to only allow a limited opening of the movable handle.

Accordingly, it is an object of the present invention to provide a locking pliers, which requires less effort to operate than that of the prior art.

These and additional objects, advantages, features and benefits of the present invention will become apparent from the following specification.

DETAILED DESCRIPTION OF THE PREFERRED EMBODIMENTS

Figure 1:
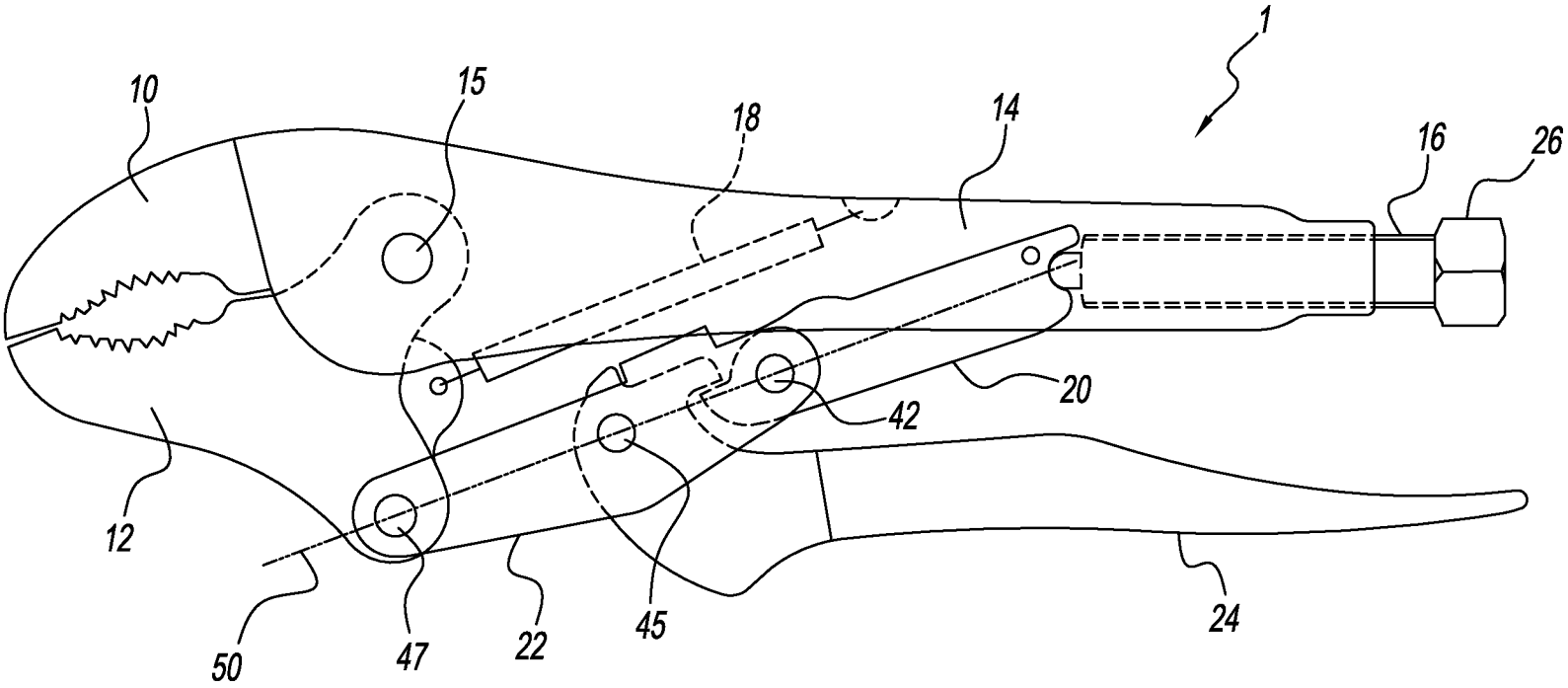
FIG. 1 is a side view of a locking pliers in a closed orientation in accordance with the present invention.
Figure 2:
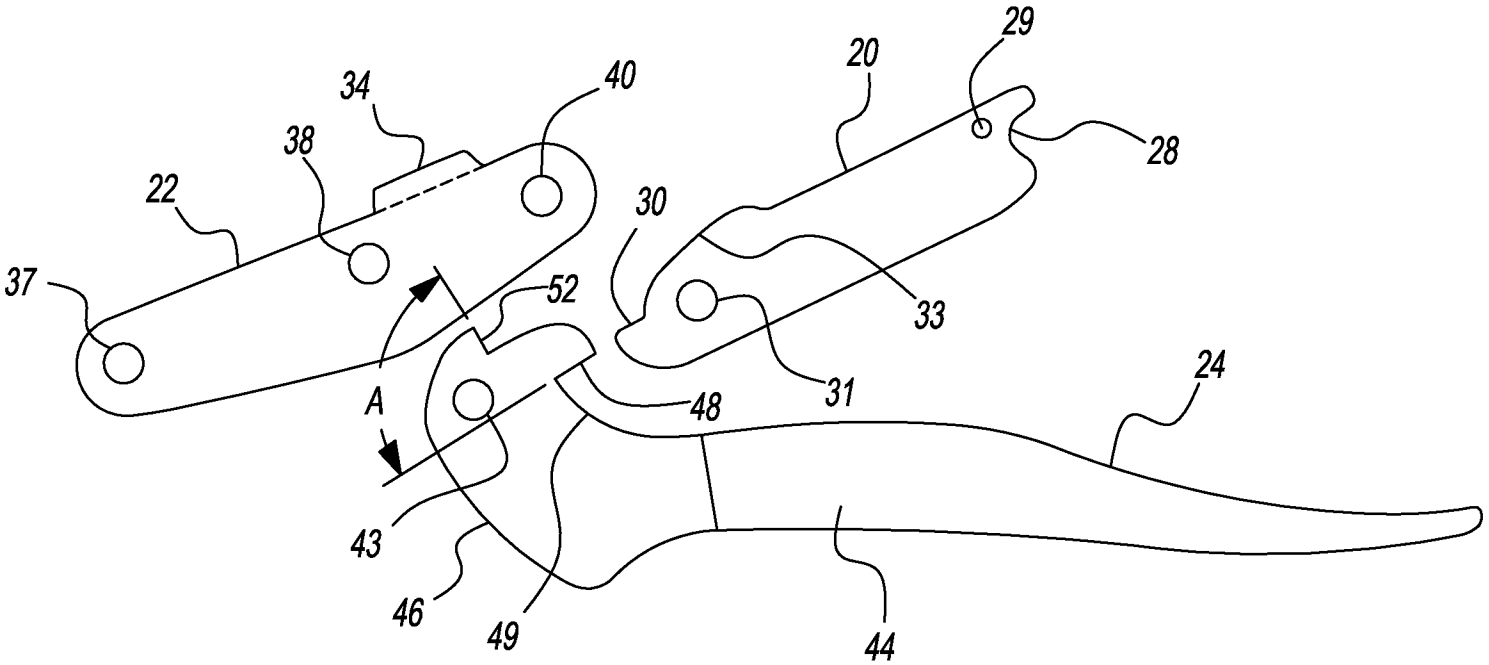
FIG. 2 is an exploded side view of a toggle link, a power link and a movable handle of a locking pliers in a closed orientation in accordance with the present invention.
Figure 3:
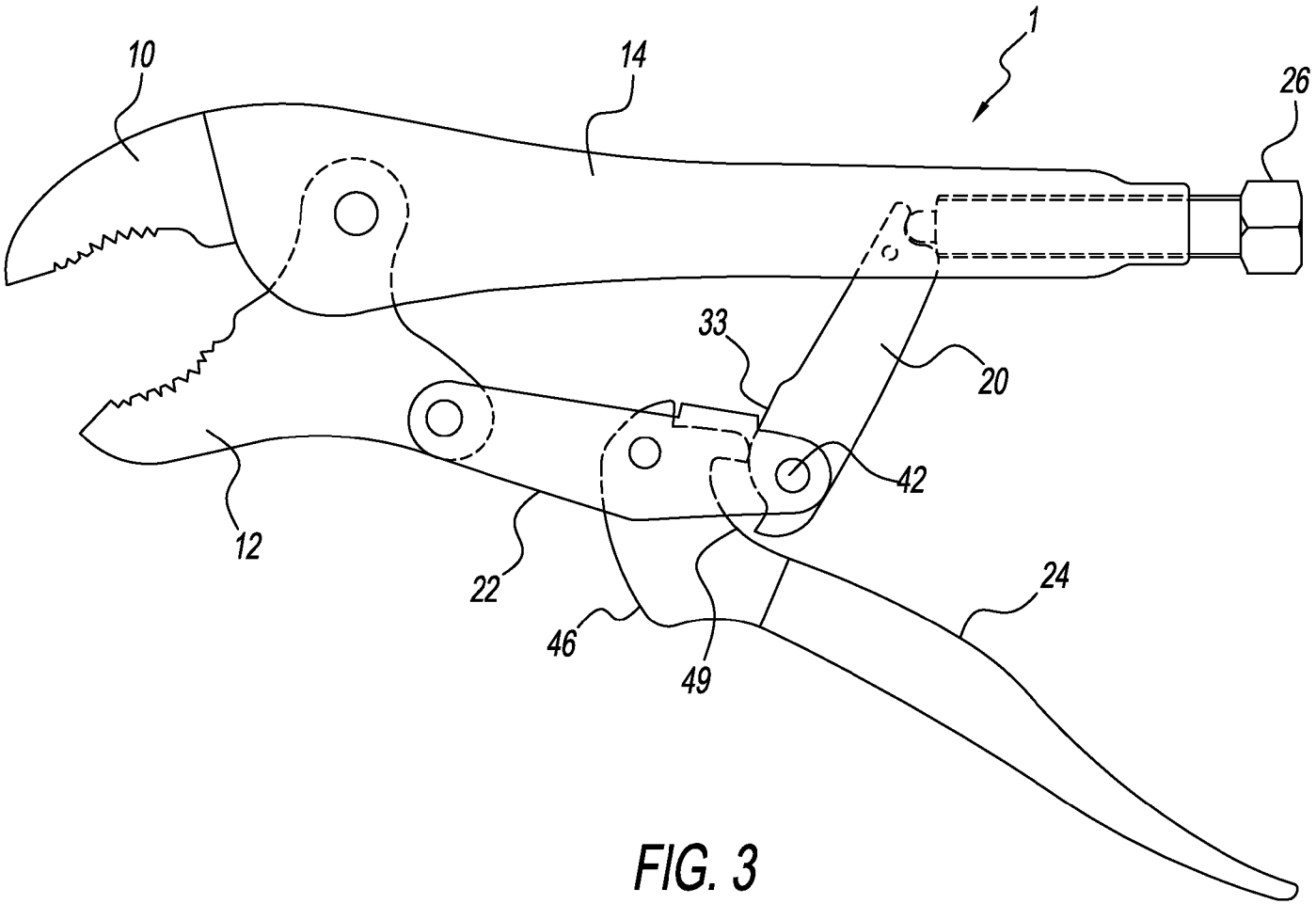
FIG. 3 is a side view of a locking pliers in an open orientation in accordance with the present invention.
Figure 5:
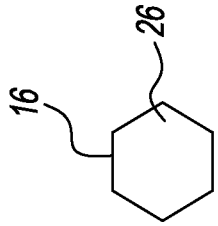
FIG. 5 is an end view of an adjusting screw of a locking pliers in an open orientation in accordance with the present invention.

With reference now to the drawings, and particularly to FIG. 1, there is shown a side view of a one handed quick release locking pliers 1. With reference to FIGS. 2-3, the locking pliers 1 preferably includes a fixed jaw 10, a movable jaw 12, a fixed handle 14, an adjusting screw 16, a biasing spring 18, a toggle link 20, a power link 22 and a movable handle 24. The fixed jaw 10, the movable jaw 12, the fixed handle 14, the adjusting screw 16 and the biasing spring 18 are preferably taken from an Irwin item no. 502L3 vise grips, but other parts may also be used. U.S. Pat. No. 5,056,385 is hereby incorporated into this patent application by reference in its entirety. The fixed jaw 10 is retained in one end of the fixed handle 14 and the adjusting screw is threadably retained in an opposing end of the fixed handle 14. The movable jaw 12 is pivotally retained in the one end of the fixed handle 14 with a pivot pin 15. One end of the biasing spring 18 is attached to the movable jaw 12 and the other end is attached to the fixed handle 14. A hex head 26 is preferably formed on an end of the adjusting screw 16 to receive a standard sized hex socket, open end wrench or closed end wrench. The hex head 26 is used to increase point pressure of the fixed and movable jaws 14, 24.

The toggle link 20 includes a first end and a second end. A pivot cavity 28 is formed in the first end of the toggle link 20. A drop pin 29 is preferably retained adjacent the pivot cavity 28. The drop pin 29 prevents the toggle link 20 from dropping out of the fixed handle 14. However, the drop pin 29 may be replaced with any suitable drop projection. A toggle link release surface 30 extends from a second end of the toggle link 20. A toggle pivot hole 31 is formed through a second end of the toggle link 20, adjacent the toggle link release surface 30.

Figure 4:
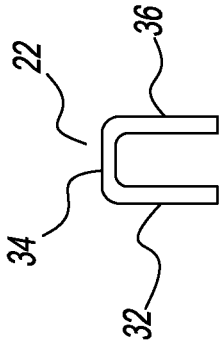
FIG. 4 is an view of a power link of a locking pliers in an open orientation in accordance with the present invention.
Figure 6:
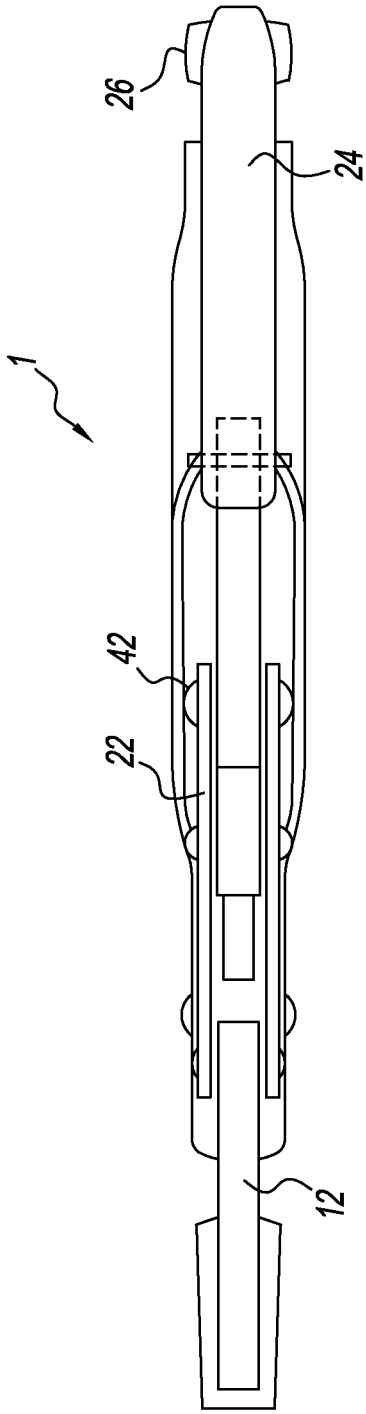
FIG. 6 is a bottom view of a locking pliers in a closed orientation in accordance with the present invention.

With reference to FIG. 4, the power link 22 preferably includes a U-shaped cross-section. A first power plate 32 extends downward from a first end of a cross power plate 34 and a second power plate 36 extends downward from a second end of the cross power plate 34. The power link 22 also includes a first end, a middle portion and a second end. A jaw pivot hole 37 is formed through the first end of the power link 22; a handle pivot hole 38 is formed through the middle portion; and a toggle pivot hole 40 is formed through the second end. The second end of the toggle link 20 is pivotally engaged with the power link 22 by retaining a toggle pin 42 in the toggle pine hole 31 and the toggle pivot hole 40. The movable handle 24 is pivotally connected to the power link 22 by retaining a pivot pin 45 in the handle pivot hole 38 and a handle pivot hole 43. The power link 22 is pivotally connected to the movable jaw 12 by retaining a jaw pivot pin 47 in the jaw pivot hole 37 and the movable jaw 12. A lever open stop surface 33 is formed on the toggle link 20, adjacent the toggle link release surface 30. The lever open stop surface 33 contacts an edge of the cross power plate 34 and limits the travel of the movable lever 24 relative to the fixed handle 14.

The movable handle 24 includes a handle portion 44 and an actuation portion 46. The handle portion 44 includes a first end and a second end. The actuation portion 46 extends from a first end of the handle portion. A toggle link release projection 48 extends outward from the actuation portion 46. The toggle link release projection 48 allows an object to be removed from the locking pliers 1. An over-center line 50 is shown in FIG. 1. An inside surface 49 of the actuation portion 46 contacts an edge of the toggle link release surface 30 to push pivot pins 42, 45 past the over-center line 50 to clamp an object in the locking pliers 1.

A power link release projection 52 extends outward from the actuation portion 46, substantially perpendicular (as shown by angle 'A') to the toggle link release projection 48. Moving a second end of the movable handle 24 away from the fixed handle 14 will cause the power link release projection 52 to push the cross power plate 34 and release a clamped object. The power link release projection 52 contacts an edge of the cross power plate 34 to only allow a limited opening of the movable handle 24.

While particular embodiments of the invention have been shown and described, it will be obvious to those skilled in the art that changes and modifications may be made without departing from the invention in its broader aspects, and therefore, the aim in the appended claims is to cover all such changes and modifications as fall within the true spirit and scope of the invention.

We claim:

1. A one handed quick release locking pliers comprising:

a fixed handle having an adjusting means disposed on one end;

a fixed jaw is rigidly retained in an opposing end of the fixed handle;

a movable jaw is pivotally retained in substantially the opposing end of the fixed handle;

a power link having a first end, a second end and a middle portion, said first end is pivotally engaged with said movable jaw, said power link having a U-shaped cross section, said U-shaped cross section includes a first power plate extending downward from a first end of a cross power plate, a second power plate extending downward from a second end of said cross power plate;

a movable handle having one end pivotally retained by said middle portion of said power link; and a toggle link having a first end and a second end, said first end makes contact with an end of said adjusting means, said second end of said toggle link is pivotally engaged with said second end of said power link.

2. The one handed quick release locking pliers of claim 1 wherein:

a biasing spring having one end secured to the movable jaw and an opposing end secured to the fixed handle.

3. The locking pliers of claim 2 wherein:

the adjusting means is an adjustment screw.

4. The locking pliers of claim 3 wherein:

a pivot cavity is formed in said first end of said toggle link, an end of said adjusting screw has pivotal engagement with said pivot cavity.

5. The locking pliers of claim 4 wherein:

a drop pin is retained adjacent said pivot cavity.

6. The locking pliers of claim 1 wherein:

said movable handle includes an actuation portion and a handle portion, said actuation portion is pivotally engaged with said power link.

7. The locking pliers of claim 1 wherein:

a lever open stop surface is formed on said toggle link, wherein said lever open stop surface contacts said power link to limit travel of said movable lever relative to the fixed handle.

8. A one handed quick release locking pliers comprising:

a fixed handle having an adjusting means disposed on one end;

a fixed jaw is rigidly retained in an opposing end of the fixed handle;

a movable jaw is pivotally retained in substantially the opposing end of the fixed handle;

a power link having a first end, a second end and a middle portion, said first end is pivotally engaged with said movable jaw, said power link having a U-shaped cross section, said U-shaped cross section includes a first power plate extending downward from a first end of a cross power plate, a second power plate extending downward from a second end of said cross power plate, a movable handle having one end pivotally retained by said middle portion of said power link, a toggle link stop projection extends outward from said first end of said movable handle, a power link release projection extends outward from said first end of said movable handle substantially perpendicular to said toggle link stop projection; and a toggle link having a first end and a second end, said first end makes contact with an end of said adjusting means, said second end of said toggle link is pivotally engaged with said second end of said power link, a toggle link release surface extends from said second end of said toggle link.

9. The one handed quick release locking pliers of claim 8 wherein:

a biasing spring having one end secured to the movable jaw and an opposing end secured to the fixed handle.

10. The locking pliers of claim 8 wherein:

the adjusting means is an adjustment screw.

11. The locking pliers of claim 10 wherein:

a pivot cavity is formed in said first end of said toggle link, an end of said adjusting screw has pivotal engagement with said pivot cavity.

12. The locking pliers of claim 11 wherein:

a drop pin is retained adjacent said pivot cavity.

13. The locking pliers of claim 8 wherein:

said movable handle includes an actuation portion and a handle portion, said actuation portion is pivotally engaged with said power link.

* * * * *